US007743773B2

(12) United States Patent
Gaworski

(10) Patent No.: US 7,743,773 B2
(45) Date of Patent: Jun. 29, 2010

(54) OVER-WRAP FOR SMOKING ARTICLE

(75) Inventor: Charles L. Gaworski, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 976 days.

(21) Appl. No.: 11/493,664

(22) Filed: Jul. 27, 2006

(65) Prior Publication Data

US 2007/0074735 A1 Apr. 5, 2007

Related U.S. Application Data

(60) Provisional application No. 60/703,471, filed on Jul. 29, 2005.

(51) Int. Cl.
*A24D 1/02* (2006.01)

(52) U.S. Cl. ..... 131/365

(58) Field of Classification Search ..... 131/365
See application file for complete search history.

(56) References Cited

U.S. PATENT DOCUMENTS

| | | | | |
|---|---|---|---|---|
| 2,667,170 | A | 1/1954 | Lebert | |
| 2,900,989 | A | 8/1959 | Davidson | |
| 4,295,478 | A | 10/1981 | Yeatts | |
| 4,582,071 | A | 4/1986 | Westcott et al. | |
| 4,587,982 | A | 5/1986 | Adams et al. | |
| 4,608,999 | A * | 9/1986 | Johnson | 131/336 |
| 4,617,946 | A | 10/1986 | Keith | |
| 5,394,895 | A | 3/1995 | Muramatsu et al. | |
| 6,457,475 | B1 | 10/2002 | Tani et al. | |
| 6,568,402 | B1 | 5/2003 | Kaneki et al. | |

FOREIGN PATENT DOCUMENTS

| | | | |
|---|---|---|---|
| EP | 0124179 | A | 11/1984 |
| EP | 0536407 | A1 | 4/1993 |
| GB | 936772 | A | 9/1963 |
| GB | 1151634 | A | 5/1969 |

OTHER PUBLICATIONS

International Search Report and Written Opinion dated Apr. 24, 2007 for PCT/IB2006/003798.

* cited by examiner

*Primary Examiner*—Carlos Lopez
(74) *Attorney, Agent, or Firm*—Buchanan Ingersoll & Rooney PC

(57) ABSTRACT

An over-wrap for connecting a tobacco rod and a cigarette filter. The over-wrap includes a tipping wrapper and a plurality of raised ribs extending from the tipping wrapper and forming a plurality of channels between the tipping wrapper and the plug wrap. The plurality of channels allow air to flow from a tobacco rod end of the filter to a plurality of ventilation holes within a plug wrap of the filter when the over-wrap is wrapped around the filter and tobacco rod.

10 Claims, 2 Drawing Sheets

OVER-WRAP FOR SMOKING ARTICLE

CROSS REFERENCE TO RELATED APPLICATIONS

This application claims priority under 35 U.S.C. §119(e) to U.S. provisional Application No. 60/703,471, filed on Jul. 29, 2005, the entire content of which is incorporated herein by reference.

BACKGROUND

Smoking articles, particularly cigarettes, generally comprise a tobacco rod of shredded tobacco (usually, in cut filler form) surrounded by a paper wrapper, and a cylindrical filter aligned in an end-to-end relationship with the tobacco rod. Typically, the filter includes a plug of cellulose acetate tow attached to the tobacco rod by tipping material or paper. Ventilation of mainstream smoke is achieved with a row or rows of perforations about a location along the filter. Such ventilation provides dilution of drawn mainstream smoke with ambient air to reduce the delivery of tar.

SUMMARY

In accordance with one embodiment, an over-wrap for connecting a tobacco rod and a filter comprises a tipping wrapper; and a plurality of raised ribs extending from the tipping wrapper and forming a plurality of channels between the tipping wrapper and the filter, wherein the plurality of channels allow air to flow from the tobacco rod end of the filter to a plurality of ventilation holes within a plug wrap of the filter when the over-wrap is wrapped around the filter and the tobacco rod.

In accordance with another embodiment, a cigarette comprises a tobacco rod including a tobacco filler and a wrapper around the tobacco filler; a filter comprising a filter material and a plug wrap wrapped around the filter material; and an over-wrap for connecting the tobacco rod and the filter, the over-wrap comprises a tipping wrapper; and a plurality of raised ribs extending from the tipping wrapper and forming a plurality of channels between the tipping wrapper and the plug wrap, wherein the plurality of channels allow air to flow from the tobacco rod end of the filter to a plurality of ventilation holes within the plug wrap when the over-wrap is wrapped around the filter and tobacco rod.

DETAILED DESCRIPTION

Figure 1:
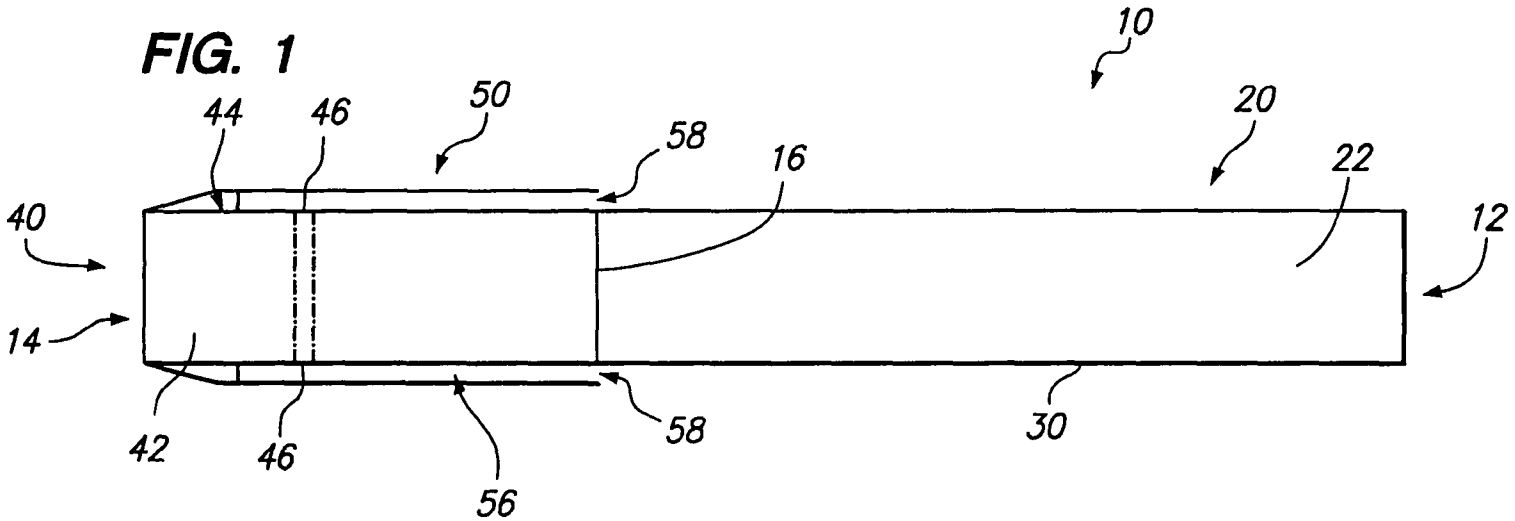
FIG. 1 shows a cross sectional view of a cigarette having a ribbed over-wrap.

FIG. 1 shows a cross-sectional view of a cigarette 10 having a cylindrical rod 20 of smokable material 22, a filter 40 and an over-wrap 50. The over-wrap 50 comprises a tipping material 52 (FIGS. 3 and 4) and a plurality of raised ribs 54 (FIGS. 3 and 4) extending therefrom and forming a plurality of channels 56, which are configured to allow air to enter the filter 40.

As shown in FIG. 1, the cigarette 10 comprises a generally cylindrical rod 20 of smokable material 22, such as tobacco cut filler, contained in a circumscribing wrapping material 30. The rod 20 is typically referred to as a "tobacco rod."

The cigarette 10 also includes a filter 40 positioned adjacent one end (i.e., the tipped end 16) of the tobacco rod 20 such that the filter 40 and tobacco rod 20 are axially aligned in an end-to-end relationship, preferably abutting one another.

The filter 40 typically includes a filter material 42 (e.g., starch-based, polypropylene, or plasticized cellulose acetate tow) circumscribed by plug wrap 44. The filter material 42 also can have the form of a gathered web (e.g., polypropylene web, polyester web or starch-based web). If desired, the filter material 42 can have at least one cavity, sleeve, sorbent, passage or groove (not shown) extending longitudinally therethrough or partially therethrough. The plug wrap 44 is typically a paper-like material, which optionally incorporates a carbonaceous material. However, the plug wrap 44 may be made of any suitable material. The plug wrap 44 circumscribes the total length of the filter 40.

A series of ventilation holes or perforations 46 in the plug wrap 44 allow air to enter the filter 40. As shown in FIG. 1, the series of ventilation holes or perforations 46 are typically located nearer the buccal (mouth) end 14 of the filter 40 than the opposite end 17 of the filter 40. However, it can be appreciated that the ventilation holes or perforations 46 can be located in the plug wrap 44 at any suitable location.

The filter 40 is attached to the tobacco rod 20 by an over-wrap 50 which circumscribes the entire length of the filter 40 and an adjacent region of the tobacco rod 20. The over-wrap 50 includes a tipping material 52 (FIGS. 3 and 4) and a plurality of raised ribs 54 (FIGS. 3 and 4) extending from the tipping material 52. The plurality of raised ribs 54 form the plurality of channels 56 (FIG. 3) configured to allow air to enter the filter 40 between the tipping material 52 and the plug wrap 44.

The over-wrap 50 extends from the butt end 14 of the cigarette 10 to an adjacent region of the tobacco rod 20. As shown in FIG. 1, the over-wrap 50 comprises the tipping material 52 and the raised ribs 54, which facilitates air dilution entry from the tobacco rod end 16 of the filter 40. The channels 56 extend from the tobacco rod end 16 of the filter 40 toward the butt end 14 of the filter 40 and the series of ventilation holes or perforations 46 within the plug wrap 44.

In one embodiment, the over-wrap 50 is sealed at the butt end 14 of the cigarette 10 with an adhesive. It can be appreciated that the sealing at the mouth end 14 of the cigarette 10 can also be performed by crimping or other suitable method. The sealing of the butt end 14 prevents leakage of smoke from the over-wrap 50 and filter 40 as a puff is drawn from the cigarette 10.

As shown in FIG. 1, the over-wrap 50 forms a ribbed filter tipping over-wrap, which is applied to the plug wrap 44. The plug wrap 44 covers the cellulose acetate filter material 42 and is intended to facilitate air dilution entry from the tobacco rod end 16 of the filter 40 (i.e., nearer the lit end of the cigarette 10) through the plurality of channels 56. (FIG. 3) The plurality of channels 56 allow air to enter between the tipping material 52 and the plug wrap 44. The airflow path 58 extends from the tobacco rod end 16 of the filter 40 to the series of ventilation holes or perforations 46 within the plug wrap 44, which are located nearer to the mouth end 14 of the cigarette 10 than the upstream end 16 of the filter 40.

As shown in FIGS. 1-4, this embodiment prevents accidental blockage of perforations or ventilation holes located within a tipping paper or over-wrap material by the smoker's lips or fingers. It can be appreciated that the accidental or intentional blockage of the ventilation holes can decrease the intended air dilution feature of a low tar yield cigarette 10 and thus result in delivery of higher tar yields. Thus, the use of a plurality of channels 56, which are configured to allow air to enter the filter 40 at the tobacco rod end 16 of the filter 40, the chance for accidental blockage, is virtually eliminated, with intentional blockage made much more difficult.

Figure 2:
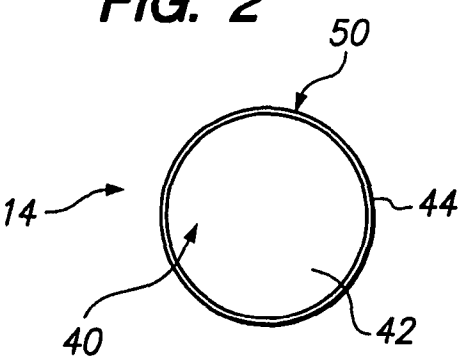
FIG. 2 shows an end view of the cigarette of FIG. 1 having a ribbed over-wrap.

FIG. 2 shows the mouth end 14 of a cigarette 10 having an over-wrap 50 as shown in FIG. 1. As shown in FIG. 2, the mouth end 14 comprises a filter 40 including a filter material 42, which is circumscribed by a plug wrap 44. The over-wrap 50 at the butt end 14 is sealed to prevent leakage and to direct the flow path of air from the tobacco rod end 16 of the filter 40 through the channels 56 (FIG. 3) between the tipping material 52 (FIG. 4) and the plug wrap 44 and through the series of ventilation holes or perforations 46 in the plug wrap 44.

Figure 3:
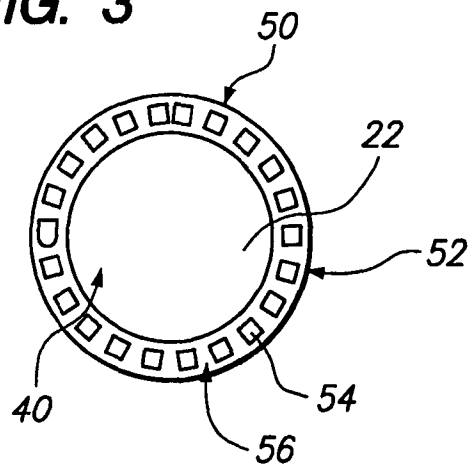
FIG. 3 shows an end view of the cigarette of FIG. 1 adjacent to where the tobacco rod abuts the filter.

FIG. 3 shows a cross-sectional view of the cigarette 10 of FIG. 1 taken at an area adjacent to where the filter 40 abuts the tobacco rod 20. As shown in FIG. 1, the tobacco rod 20 is circumscribed by a wrapping material 30, which abuts the plug wrap 44 of the filter 40. The plurality of raised ribs 54 form a plurality of channels 56 extending from the tobacco rod end 16 of the filter 40 towards the butt end 14 of the cigarette 10. The raised ribs 54 are preferably spaced at an equal distance from one another to form channels 56 of equal size and shape. However, it can be appreciated that the size and shape of the raised ribs 54 and the ensuing channels 56 can vary. In addition, the channels 56 preferably run parallel to a longitudinal axis of the filter 40.

Figure 4:
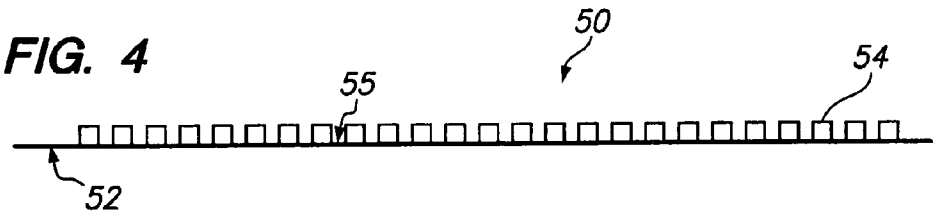
FIG. 4 shows a cross sectional view of the ribbed over-wrap.

The over-wrap 50 attaches to the plug wrap 44 and wrapping material 30 of the tobacco rod 20 via the plurality of raised ribs 54 at an inner surface 55 (FIG. 4). It can be appreciated that the ribs 54 of the over-wrap 50 can be attached to the filter 40 and wrapping material 30 of the cigarette 10 via an adhesive film or other suitable material or composition.

FIG. 4 shows the over-wrap 50 before the over-wrap 50 is applied or wrapped around the filter 40 and tobacco rod 20. As shown in FIG. 4, the over-wrap 50 comprises a tipping material 52 and a plurality of raised ribs 54, which are typically a paper like product; however, any suitable material can be used.

Figure 5:
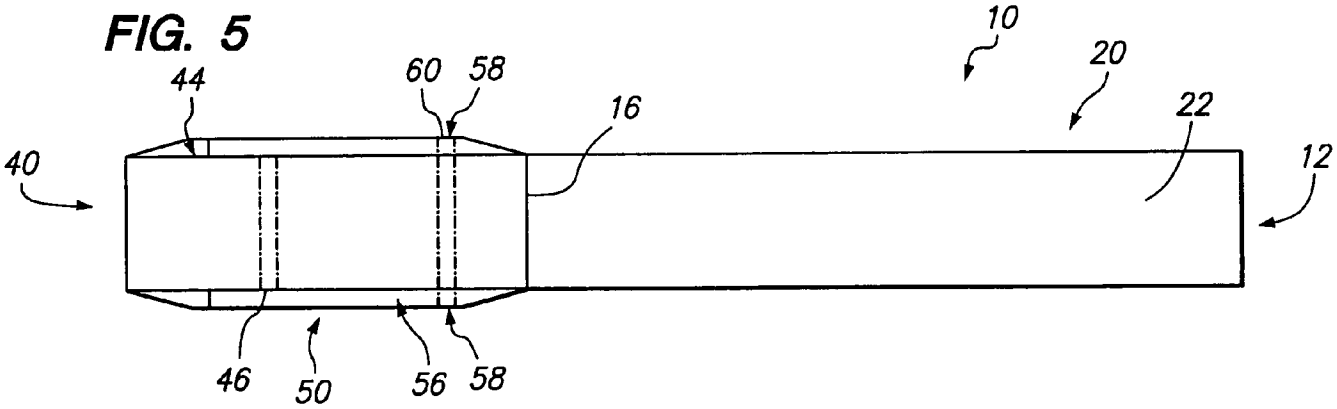
FIG. 5 shows a cross sectional view of another embodiment of a cigarette having a ribbed over-wrap.

FIG. 5 shows another embodiment of a cigarette 10 having a over-wrap 50. As shown in FIG. 5, the cigarette 10 comprises a cylindrical rod 20 of smokable material 22, a filter 40 and an over-wrap 50. The over-wrap 50 has a series of ventilation holes or perforations 60 in the tipping material 52. The series of ventilation holes or perforations 60 are configured to allow airflow 58 from the tobacco rod end 16 of the filter 40, when the over-wrap 50 is wrapped around the plug wrap 44. The airflow 58 extends from the ventilation holes or perforations 60 through the plurality of channels 56 between the over-wrap 50 and the plug wrap 44 to the series of ventilation holes or perforations 46 within the plug wrap 44.

In this embodiment, the over-wrap 50 is sealed at both the butt end 14 and the tobacco rod end 16 of the filter 40. The raised ribs 54 form a openings or channels 56 between the over-wrap 50 and the plug wrap 44 and in combination with the series of ventilation holes or perforations 60 in the tipping material 52 and allows air to enter the filter 40.

The ventilation holes or perforations 60 are located at the tobacco rod end 16 of (or near the end of) the filter 40, and allow air to enter through the series of ventilation holes or perforations 60 placed in the ribbed over-wrap tipping material 52. A laser preferably forms the series of ventilation holes or perforations 60 in the over-wrap 50; however any suitable method can be used.

As shown in FIG. 5, the airflow path 58 extends from the openings in the ventilation holes or perforations 60 in the tipping material 52, through the channels 56 formed between the tipping material 52 and the plug wrap 44 and through the holes or perforations 46 in the plug wrap 44 into the filter 40.

Figure 6:
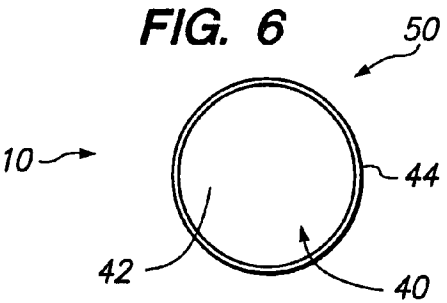
FIG. 6 shows an end view of the cigarette of FIG. 5 having a ribbed over-wrap.

FIG. 6 shows the butt end 14 of a cigarette 10 having an over-wrap 50 as shown in FIG. 5. As shown in FIG. 6, the butt end 14 comprises a filter 40 including a filter material 42, which is circumscribed by a plug wrap 44. The over-wrap 50 at the butt end 14 is sealed to prevent leakage and to direct the airflow path 58 from the tobacco rod end 16 of the filter 40, through the channels 56 between the tipping material 52 and the plug wrap 44 to the ventilation holes or perforations 46 in the plug wrap 44.

Figure 7:
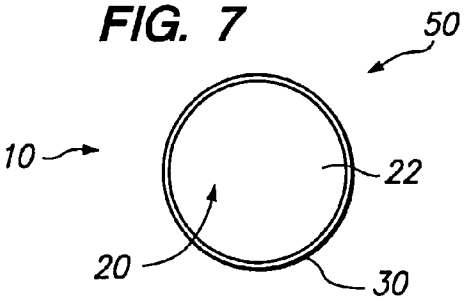
FIG. 7 shows an end view of the cigarette of FIG. 5 adjacent to where the tobacco rod abuts the filter.

FIG. 7 shows a cross-sectional view of the cigarette 10 of FIG. 5 taken at an area adjacent to the area where the filter 40 abuts the tobacco rod 20. As shown in FIG. 7, the tobacco rod 20 is circumscribed by a wrapping material 30, which abuts the plug wrap 44 of the filter 40. The plurality of raised ribs 54 extending from the tobacco rod end 16 of the over-wrap 50 towards the butt end 14 of the cigarette 10 are not shown in FIG. 7, since the over-wrap 50 is sealed at the tobacco rod end 16 of the cigarette 10. Although not shown in FIGS. 5-7, the raised ribs 54 are preferably spaced at an equal distance from one another to form channels of equal size and shape. However, it can be appreciated that the size and shape of the raised ribs 54 and the ensuing channels 56 can vary.

Although the assemblies, cigarettes and apparatuses have been described in terms of the preferred embodiments thereof, it will be appreciated by those skilled in the art that additions, deletions, modifications, and substitutions not specifically described can be made without departing

What is claimed is:

1. An over-wrap adjacent a tobacco rod and a filter comprising:

a tipping wrapper; and a plurality of raised ribs extending from the tipping wrapper and forming a plurality of channels between the tipping wrapper and the filter, wherein the plurality of channels allow air to flow from a tobacco rod end of the filter to a plurality of ventilation holes within a plug wrap of the filter when the over-wrap is wrapped around the filter and the tobacco rod, wherein the over-wrap is crimped at a butt end of the filter to prevent leakage.

2. The over-wrap of claim 1, wherein the tipping wrapper has a plurality of ventilation holes.

3. The over-wrap of claim 2, wherein the plurality of ventilation holes are located nearer the tobacco rod end of the filter than the butt end of the filter.

4. A cigarette comprising:

a tobacco rod including a tobacco filler and a wrapper around the tobacco filler;

a filter comprising a filter material and a plug wrap wrapped around the filter material; and an over-wrap connecting the tobacco rod and the filter, the over-wrap comprising:

a tipping wrapper; and a plurality of raised ribs extending from the tipping wrapper and forming a plurality of channels between the tipping wrapper and the plug wrap, wherein the plurality of channels allow air to flow from a tobacco rod end of the filter to a plurality of ventilation holes within the plug wrap, wherein the over-wrap is crimped at a butt end of the cigarette to prevent leakage.

5. The cigarette of claim 4, wherein the tipping wrapper has a plurality of ventilation holes.

6. The cigarette of claim 5, wherein the plurality of ventilation holes are located nearer the tobacco rod end of the filter than the butt end of the filter.

7. The cigarette of claim 6, wherein the over-wrap is sealed at the tobacco rod end of the filter to prevent leakage.

8. The cigarette of claim 4, wherein the over-wrap is open at the tobacco rod end of the filter to allow airflow into the channels.

9. The cigarette of claim 4, wherein the filter and the over-wrap adhere to each other by spot gluing the raised ribs of the over-wrap to the plug wrap and the wrapper around the tobacco filler.

10. The cigarette of claim 4, wherein the channels run parallel to a longitudinal axis of the filter.

* * * * *